US005246388A

United States Patent [19]

Collins et al.

[11] Patent Number: 5,246,388

[45] Date of Patent: Sep. 21, 1993

[54] ELECTRICAL OVER STRESS DEVICE AND CONNECTOR

[75] Inventors: Christopher J. Collins, Fremont, Calif.; James M. English, Annville; John C. Farrar, Harrisburg, both of Pa.

[73] Assignee: AMP Incorporated, Harrisburg, Pa.

[21] Appl. No.: 906,813

[22] Filed: Jun. 30, 1992

[51] Int. Cl.[5] ..... H01R 13/66

[52] U.S. Cl. ..... 439/620; 361/56; 361/111

[58] Field of Search ..... 361/56, 111; 439/620

[56] References Cited

U.S. PATENT DOCUMENTS

| | | | |
|---|---|---|---|
| 4,331,948 | 5/1982 | Malinaric et al. | 338/21 |
| 4,726,991 | 2/1988 | Hyatt et al. | 428/329 |
| 4,729,752 | 3/1988 | Dawson, Jr. et al. | 439/620 |
| 4,804,332 | 2/1989 | Pirc | 439/620 |
| 4,911,519 | 3/1990 | Burton et al. | 350/96.20 |
| 4,920,445 | 4/1990 | Jun | 361/111 |
| 4,928,199 | 5/1990 | Diaz et al. | 361/11 |
| 4,977,357 | 12/1990 | Shrier | 338/21 |
| 5,011,246 | 4/1991 | Corradetti et al. | 350/96.2 |
| 5,018,989 | 5/1991 | Black et al. | 439/620 |
| 5,068,634 | 11/1991 | Shrier | 338/21 |
| 5,099,380 | 3/1992 | Childers et al. | 361/56 |
| 5,140,299 | 8/1992 | Andrews, Jr. et al. | 338/308 |
| 5,142,263 | 8/1992 | Childers et al. | 338/21 |

OTHER PUBLICATIONS

*Electromer Drawing No. FLX-XXB001*, "Multi-Line ESD Protection Array for D-Submin Connectors", Revision E, Sep. 23, 1991; Electromer Corporation, Belmont, CA.

*Electromer Drawing No. PCE-SM01C010*, "Specification Control Drawing", Revision TM, Apr. 11, 1991; Electromer Corporation, Belmont, CA.

*Primary Examiner*—Gary F. Paumen

*Attorney, Agent, or Firm*—Katherine A. Nelson

[57] ABSTRACT

A device (24) for protecting against electrical over stress (EOS) of electrical components includes first contacts (50, 56) that interconnect to signal contacts (18) of a connector (12) and second contacts (68) that connect to the ground circuit (20) of a connector with a rigid plastic housing (26) holding the device contacts so that ends (55, 65) have a precise spacing gap (71), the gap being filled with a material matrix (72) of insulating and conductive materials having characteristics in conjunction with the gap to define transit voltage suppression by grounding the signal contacts of a connector. The device is made bendable to fit onto connectors and conform to the connector geometry.

18 Claims, 7 Drawing Sheets

Fig. 6
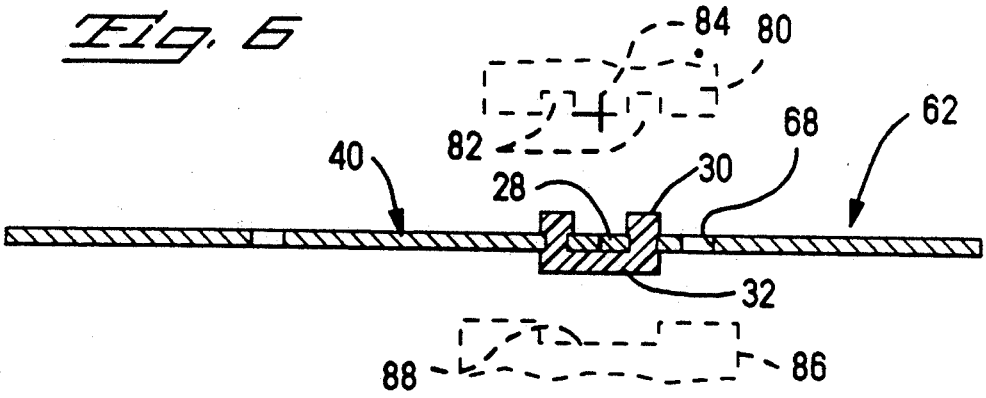
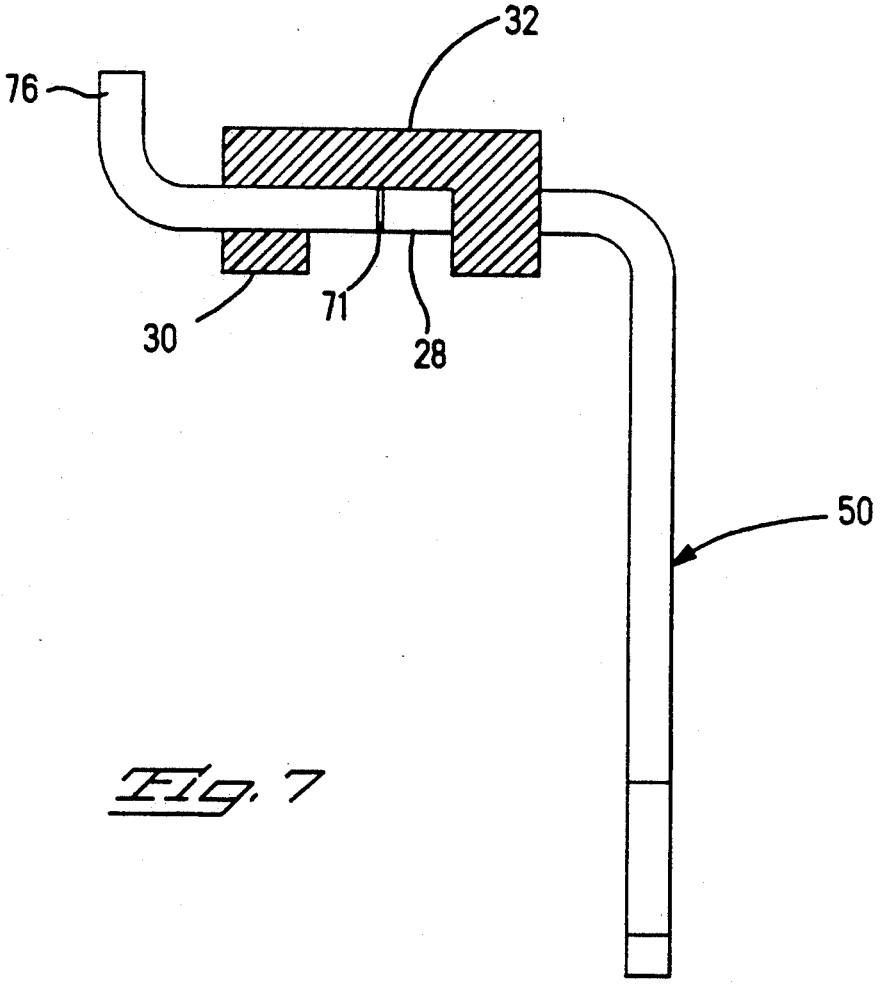
Fig. 7

ELECTRICAL OVER STRESS DEVICE AND CONNECTOR

This invention relates to an electrical over stress device and electrical connector for protecting sensitive electronic components.

RELATED APPLICATIONS

This application is related to Ser. No. 07/906,610 cofiled herewith.

BACKGROUND OF THE INVENTION

Packaging of electronic components such as integrated circuits routinely finds hundreds of circuit functions within a volume that heretofore was occupied by a single element, such as a resistor, capacitor, or inductor. As a result, the physical spacings of the elements have become quite small, and the elements themselves relatively fragile and susceptible to damage from transient signals caused by a host of phenomena met in the practical environment of use. Induced voltages from short circuits, lightning strikes, static electric charges built up on individuals or equipment, all may find their way into components and destroy the elements thereof to cause a lack of function. This failure, resulting from electrical over stress (EOS) has led to a host of circuit protection devices, typically mounted on the same circuit board upon which the components are carried. These devices have included electrical fuses that open up responsive to IR heating, typically relatively slow in action, as well as varistors, zener diodes, and a host of other devices including spark gap devices, thin film devices, and LC filters have been employed. U.S. Pat. No. 4,729,752 discloses a transient suppression device in the form of a back-to-back diode mounted on a substrate that fits within an electrical connector. This device suppresses voltages outside a specified level as they are conducted through the signal conductors of the connector and incorporation into the connector saves valuable board space.

With respect to the foregoing, all of the protection devices require either a special installation and handling or an alteration of existing designs of connectors in order to accommodate the EOS devices. Many of the prior art EOS elements are bulky, slow to respond, and expensive to acquire and install to provide protection to components upon boards. Accordingly, it is an object of the present invention to provide an EOS device that may be fitted onto electrical connectors to provide board mounted component protection against unwanted transients.

It is a further object to provide an EOS device that can be utilized with existing connector designs, without significant alteration of such connectors.

It is an additional object to provide a cost effective, readily employed EOS device and connector to provide component protection.

It is still a further object to provide, in combination, an EOS device and an electrical connector of improved features.

SUMMARY OF THE INVENTION

The present invention achieves the foregoing objectives through the provision of an EOS device of a geometry to be fitted onto electrical connectors. The device includes a plastic housing of a temperature stable material containing first and second contacts insert molded therein, each of the contacts having an end contained within an interior volume of the housing to define a precise spacing gap. That gap is filled with a material matrix of insulating, conductive, or semi-conductive particles of an extremely fine size flowed into the volume of the housing and having characteristics, taken in conjunction with the spacing gap to provide EOS protection through a change in resistance allowing unwanted transients to flow from signal paths in a connector to a ground circuit of the connector. The contacts of the device include first contacts that attach to the signal contacts of a connector and further contacts that attach to the ground circuit of a connector. The various contacts of the device are made of a thin conductive metal that is bendable to allow the device to be made to conform to a portion of the geometry of the connector, to nest and rest on portions of the connector. This allows a given device to be made to conform to the geometries of different connectors to extend the utility of a given device part number.

A method of manufacture includes forming, as by stamping or etching, thin conductive sheet stock to define the conductive elements of the device to include carrier means such as holes in the stock allowing a precise fixturing to define the spacing gap between contacts The fixtured contact portions are then insert molded by a mold clamping onto the sheet stock to mold around the surfaces of portions defining said contacts with the spacing gap between the ends of the contacts being kept clear by a shim. Once the insert molding step is achieved, the carrier portions of the sheet stock may be removed and an interior volume formed in the housing filled under pressure with a material matrix of an appropriate mixture of insulating, conductive, or semi-conductive materials to fill the gap and establish a precise dimension for the matrix that results in a precise voltage suppression, clamping voltage characteristic for the device. The contacts of the device are readily bendable to conform to a variety of standard connector formats and be applied thereto between the signal contacts of such connector and the ground circuits.

IN THE DRAWINGS

Figure 4:
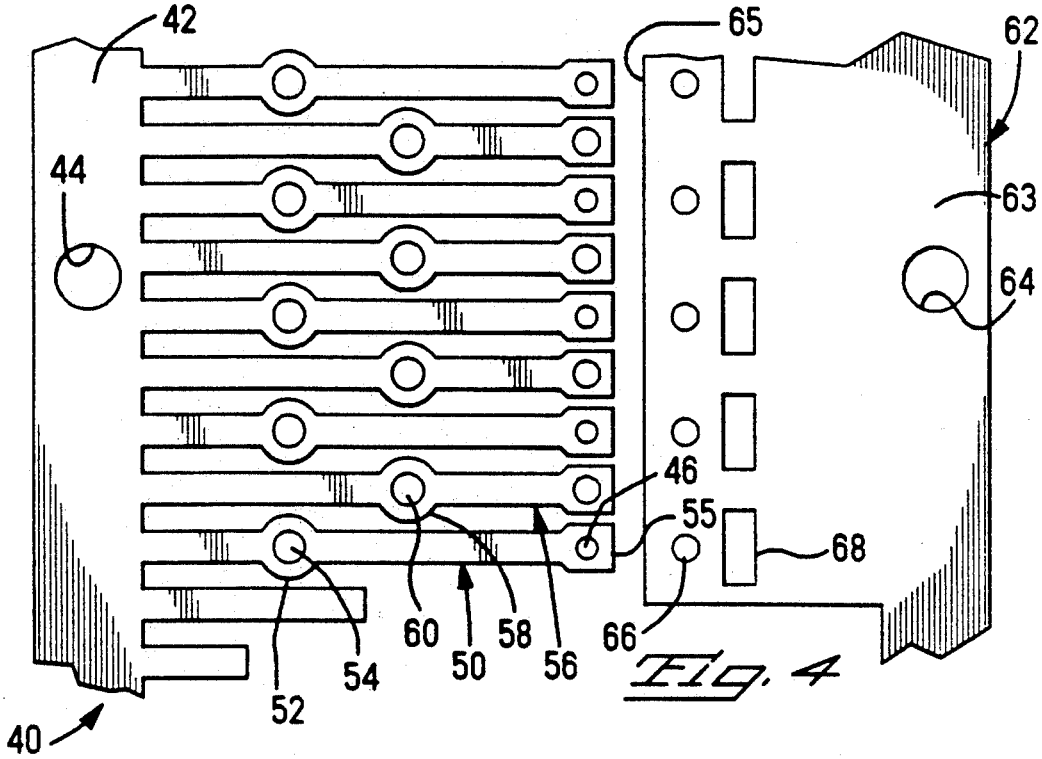
FIG. 4 is a plan view of the sheet metal blank, profiled prior to the application of a housing thereon to form a device.
Figure 5:
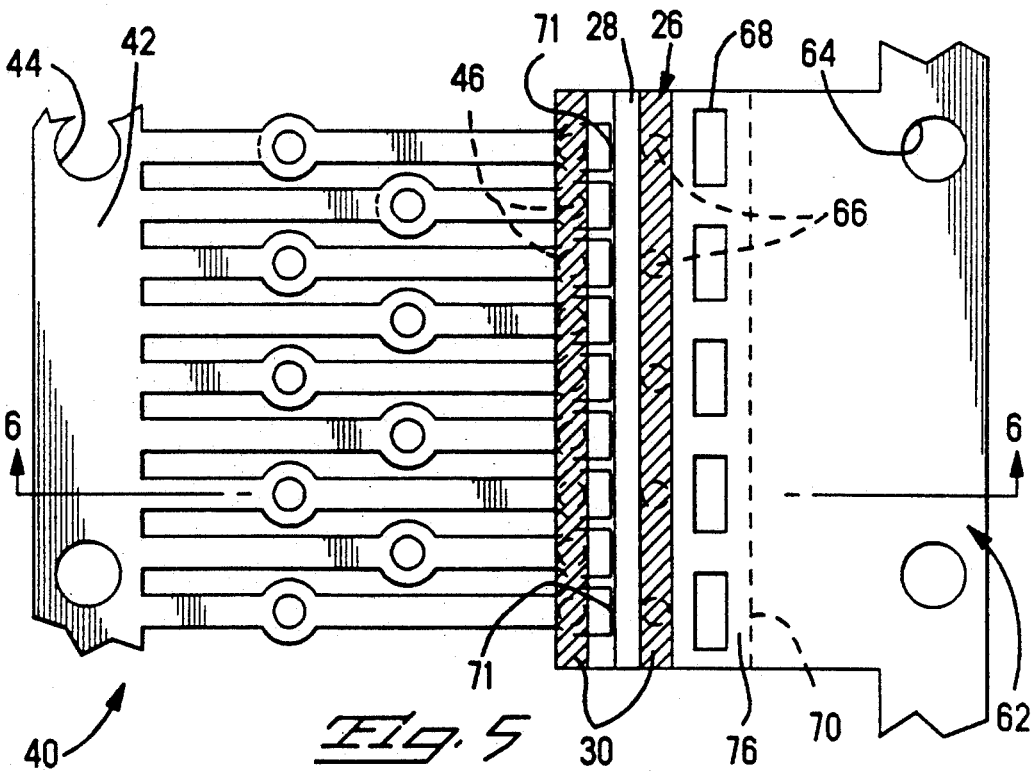

FIG. 5 a plan view of the elements shown in FIG. 4 following application of a housing to such elements.

FIG. 6 is an end, elevational and sectional view taken through lines 6-6 of FIG. 5 including a sectioning view of a mold preparatory to closure shown in phantom.

FIG. 7 is a view of the device shown in FIG. 6 following removal of carriers and formed into one configuration.

Figure 8:
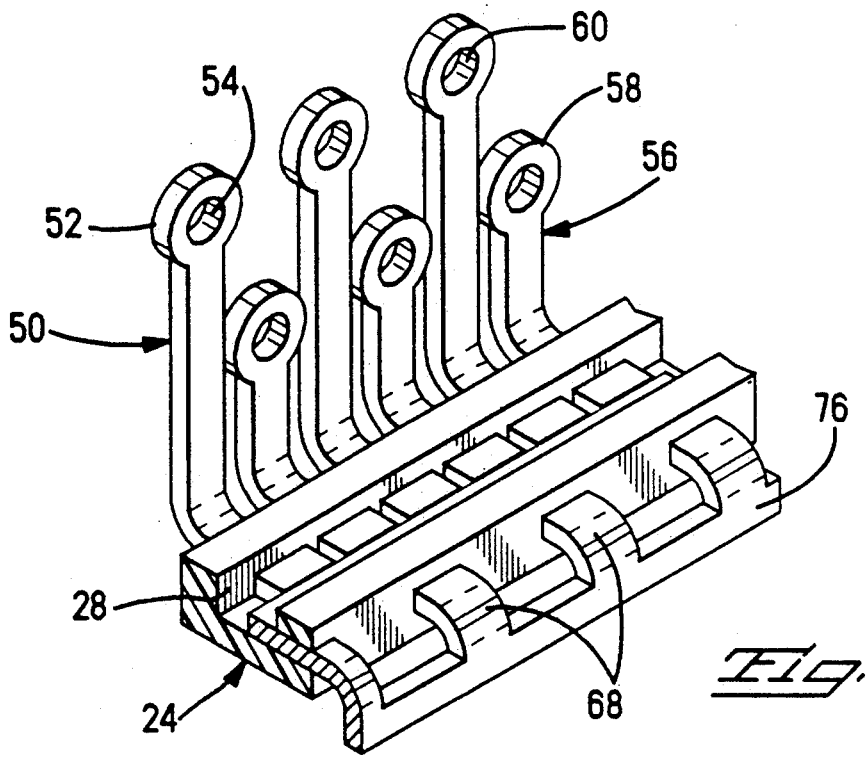

FIG. 8 is a perspective in partial section of the device shown in FIG. 7.

Figure 9:
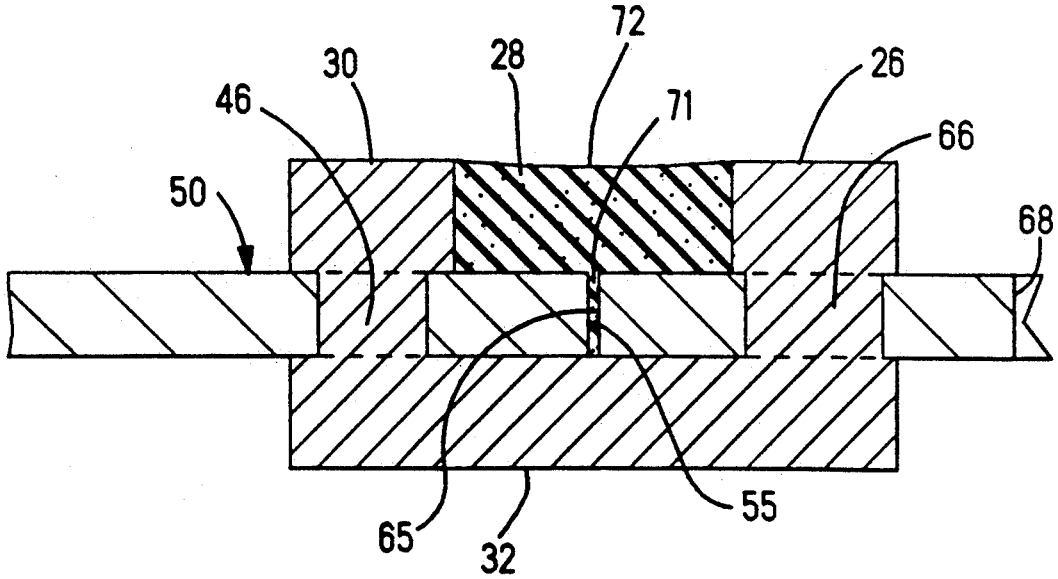

FIG. 9 is a side, elevational, and sectioned view of the EOS device following insert molding and molding of the matrix material within the housing.

Figure 10:
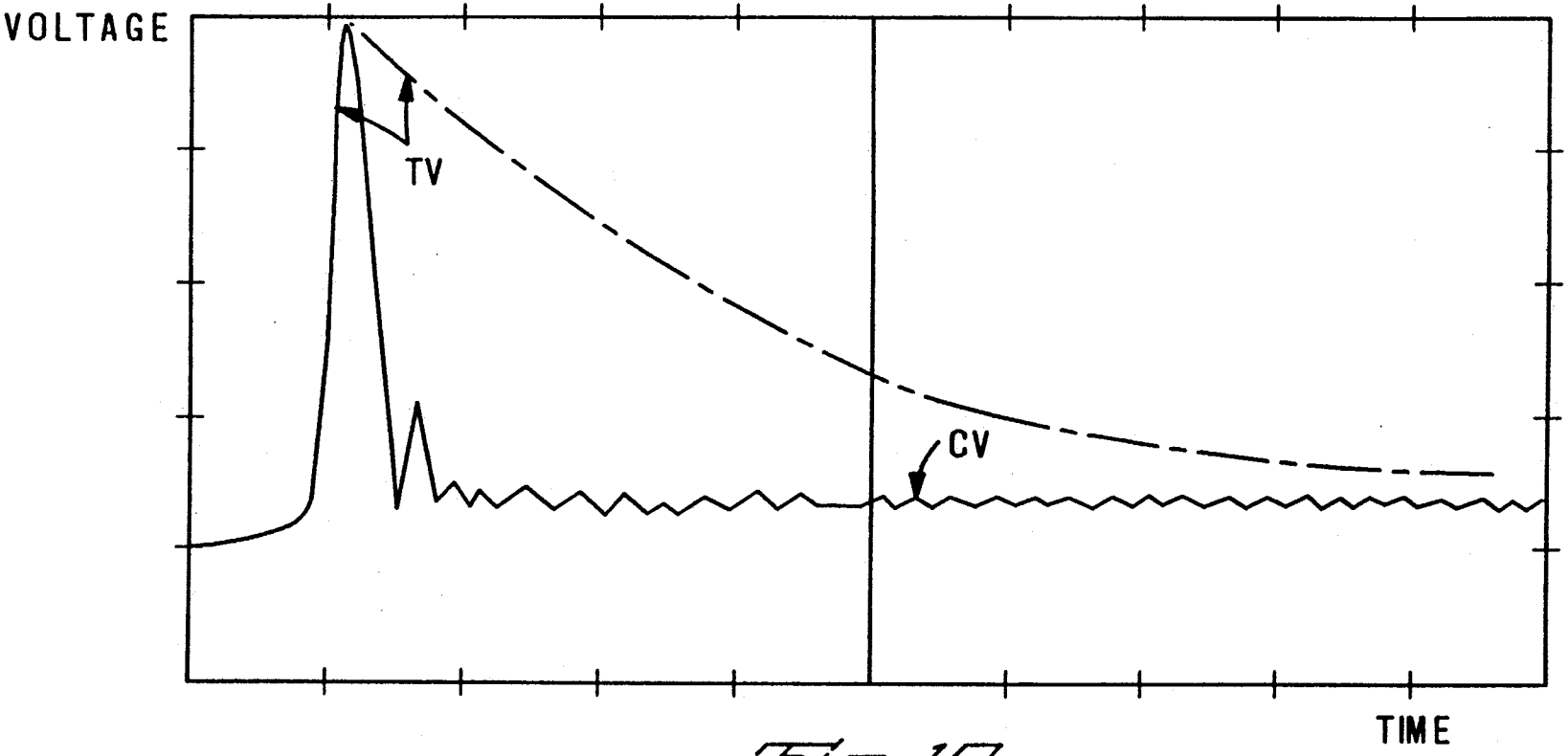

FIG. 10 is a voltage, time plot of a characteristic response of the EOS device of the invention.

Figure 11:
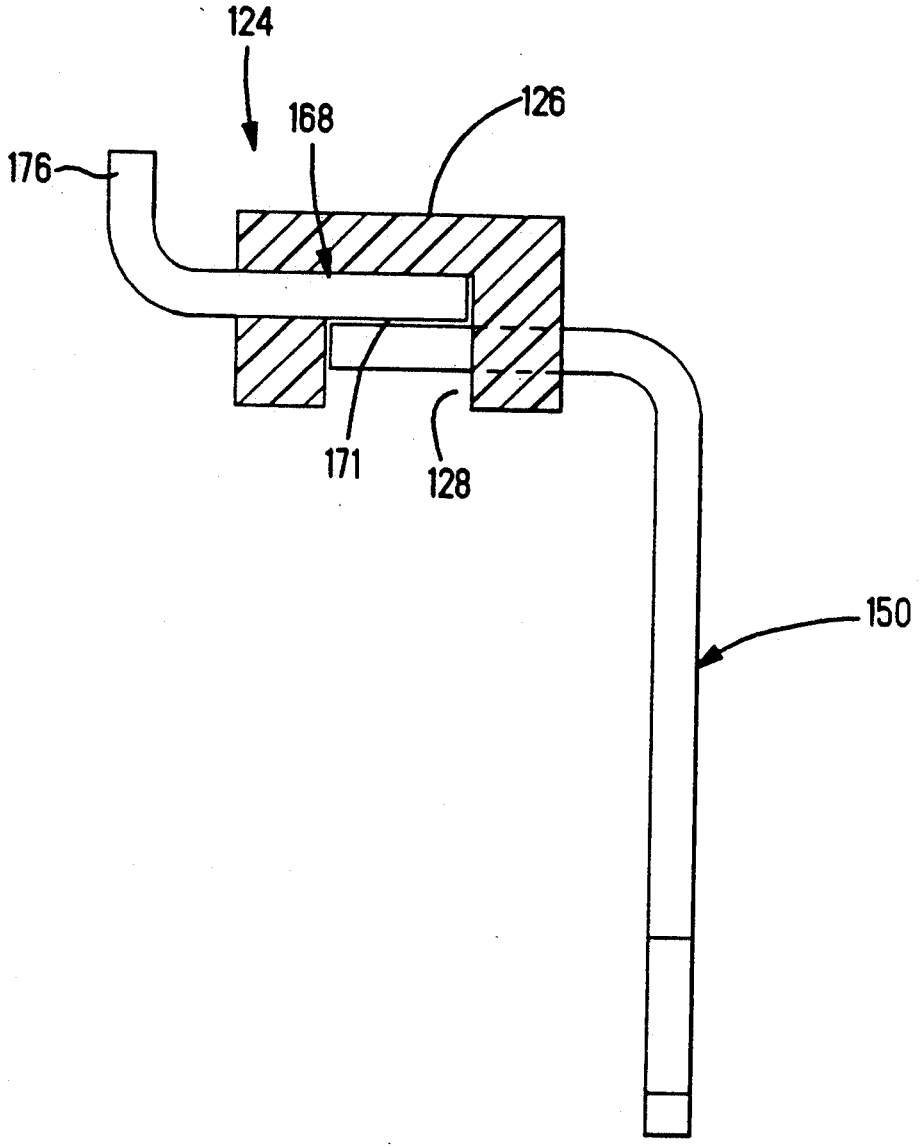

FIG. 11 is a sectional view of an alternative embodiment of the EOS device.

DETAILED DESCRIPTION OF THE INVENTION

Figure 1:
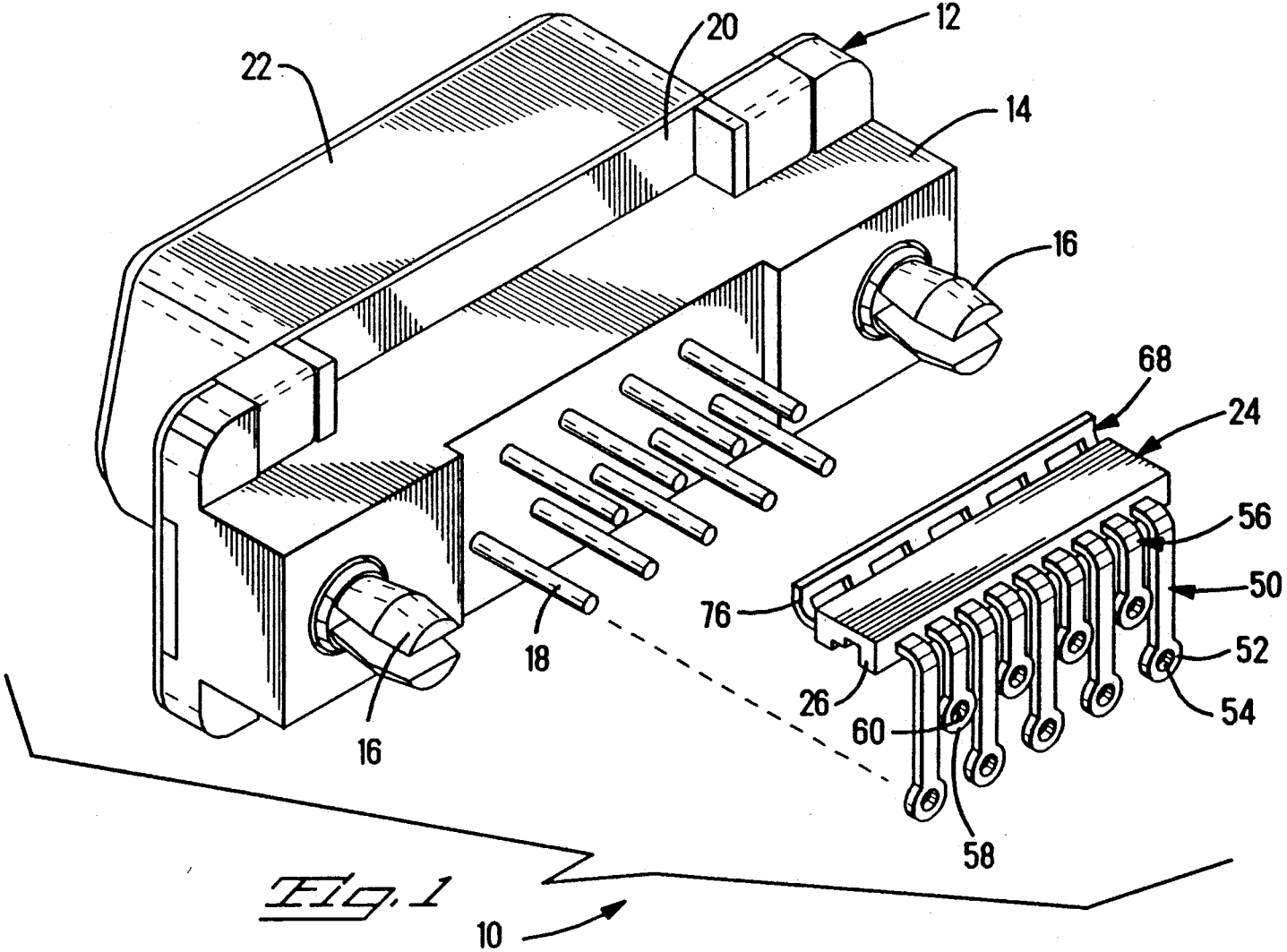
FIG. 1 is a perspective view taken from the rear of a multi-contact electrical connector, showing an EOS device spaced therefrom preparatory to application thereto.

Referring now to FIG. 1, an electrical connector assembly 10 is shown to include the connector 12 and an EOS device 24 preparatory to assembly. The connector 12 is representative of board mounted connectors that serve input, output functions to boards containing a variety of components that define computer, communication, and business machine functions. Typically, such boards contain arrays of integrated circuits that are interconnected through conductive traces within the board and connected to drive and be driven by circuits through the connector, cables, and other connectors attached to such connector. Connectors such as 12 typically include plastic and insulating housing 14, fasteners such as 16 that attach the housing to a printed circuit board, fitting through holes therein. Signal contacts 18 are shown extending from the rear face of housing 14, the forward ends being contained within the housing to mate with posts or receptacles of a mating connector, not shown, that engages connector 12. Also typical of connectors such as 12 is the provision of a grounding shield 20, made of metal that extends around the periphery of the housing 14 and, as is indicated, joins an integral metal shell 22 projecting forwardly, note the shell in FIGS. 2 and 3. Signal contacts 18 typically include post portions ended as at 19 that fit through holes or apertures in boards and are soldered thereto to join the traces of such boards and be interconnected to the components on the board.

Signals to and from these components pass through the contacts 18, and it is these signals that can, on occasion, cause EOS problems. A lightning strike, for example, not proximate to the equipment served by the connector and the components on a board upon which the connector is mounted may nevertheless induce voltages and cause a surge in transient currents to flow coupling the cable to which the connector is connected to induce transients on such cable that are conducted through the connector, onto the board, and into the components to destroy them. Static charges can build up on individuals and can readily exceed 15,000 volts and be discharged by touching a piece of equipment, cable, a keyboard, or other object interconnected by the cable and connector to a board and component. Frequently, these transient voltages are of short duration, having rise times on the order of nanoseconds and durations well under a millisecond. They nevertheless carry energy levels quite sufficient to destroy the fragile, closely-spaced traces within electronic components such as integrated circuits. The problem is complicated by the fact that high speed data transfer, typically digital pulses, typically includes fast rise time pulse configurations, but these are generally of finite voltage levels, well below those levels that can destroy or damage components.

In FIG. 10, a voltage spike labeled $T_v$ with a rise time as indicated, and an actual level indicated in phantom following the rise time. The energy contained within the envelope of $T_v$ may very well be sufficient to damage or destroy electronic components. With respect to FIG. 10, the scale for time and voltage may vary considerably from application to application with the ordinate units ranging from hundreds of volts to thousands of volts, and with the time units ranging from picoseconds to hundreds of nanoseconds per division. An EOS device should have a function that follows the solid curve, sensing the fast rise time and excessive voltage, operating to cause a conduction between a signal path where the transit is located to a ground circuit to in essence clamp the voltage in the manner shown by the portion of the curve labeled $C_v$ for clamping voltage. In this way, a circuit component will be protected by virtue of not having to experience a continuation of the high fields associated with the higher voltages of $T_v$ and additionally, the joule energy of the transient voltage, noting the reduction of energy associated with the difference between $T_v$ and $C_V$ in FIG. 10.

Reference is hereby made to three U.S. Pat. Nos. 4,331,948 and 4,726,991 drawn to electrical over stress protection materials and U.S. Pat. No. 4,977,357 drawn to an over voltage protection device and material; the three of which are incorporated by reference herein with respect to defining types of material matrices useful in EOS protection. In these patents, materials are taught, including an insulating material combined with conductor or semi-conductor particles coated with insulating material in a matrix that results in a rapid response to high energy electrical transients and controls resistance as between ground and signal circuits to provide transient protection. In the description hereinafter to follow, matrix materials are referred to in use and method of manufacture with respect to EOS devices and connectors like that shown in FIG. 1, the materials of the above-mentioned patents being preferred in certain applications due to the fast rise time responses; but it also being understood that in the broad application of transient protection, other materials having matrix constituents varying to accommodate different voltages of transients of different characteristics are fully contemplated. As mentioned in the patents, the particle size, the choice of insulating film or insulating material, the choice of semi-conductor materials, can all have an effect on the response characteristic of the device utilizing such matrix.

An additional parameter that regulates voltage transient response is the gap between electrodes attached to signal and ground circuits, such gap defining a spacing in which the matrix material resides and defining the chains of conductive or semi-conductive particles existing in such matrix and their characteristic response to voltage transients, the spacing of the gap helping to determine response characteristics. Satisfactory performance has been found in the range of 0.001 inches to 0.010 inches, preferably in the range 0.002 inches to 0.004 inches.

Figure 2:
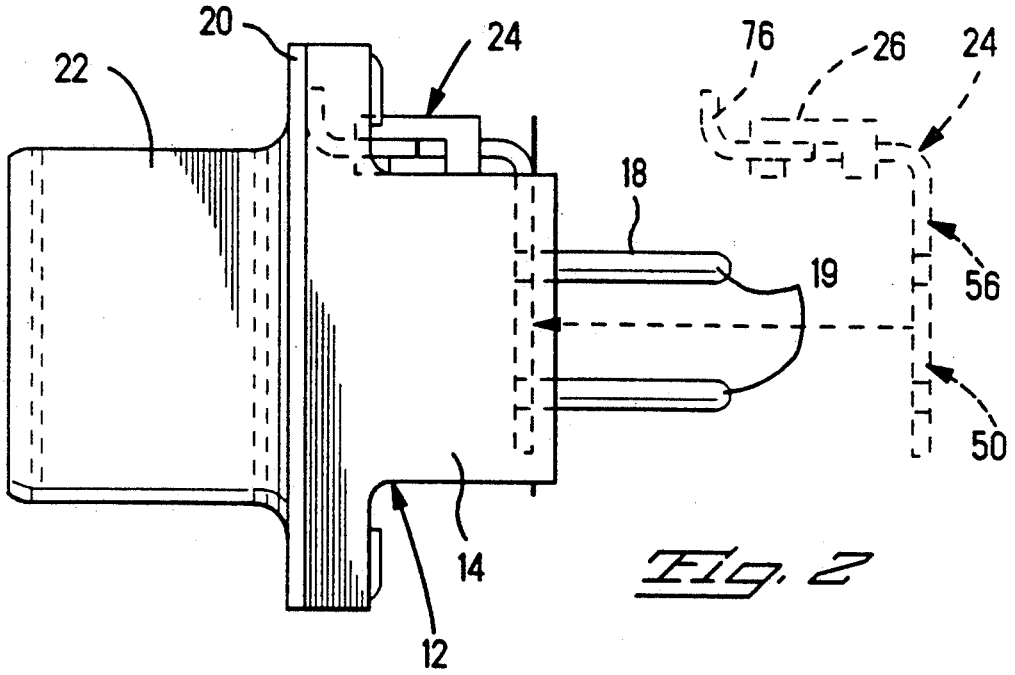
FIG. 2 is a view taken from the left-hand side of the connector as shown in FIG. 1 with the rearwardly projecting fastener portions removed and with the EOS device shown applied and, in phantom, positioned prior to application.

Referring back to FIG. 1, an EOS device 24 includes a plastic housing 26 with a series of first contacts 50 and 56 extending from one side thereof and a series of further or second contacts 68 extending from the other side thereof, connected together by a commoning bar 76. The device 24 is shown in a configuration to be applied to the connector 12 with the body of housing 26 resting on a surface of housing 14 of the connector in the manner shown in FIG. 2. As can be seen, the portion 76 rests against the grounding shield 20 and is joined thereto as by soldering or other means as known in the art. The first contacts 50 and 56 end in portions that fit over contacts 18. Contact 50 thus includes a rounded portion 52 having an aperture 54 that slips over a post portion of contact 18 and is interconnected thereto as by soldering or other means; with the contact 56 having a rounded portion 58 having an aperture 60 to fit over contact 18 and be interconnected thereto as by solder or other means. As shown in FIG. 2, the EOS device 24 fits closely to the connector 12, piggybacks on a surface thereof with the various contacts made to conform to the geometry of connector 12.

Figure 3:
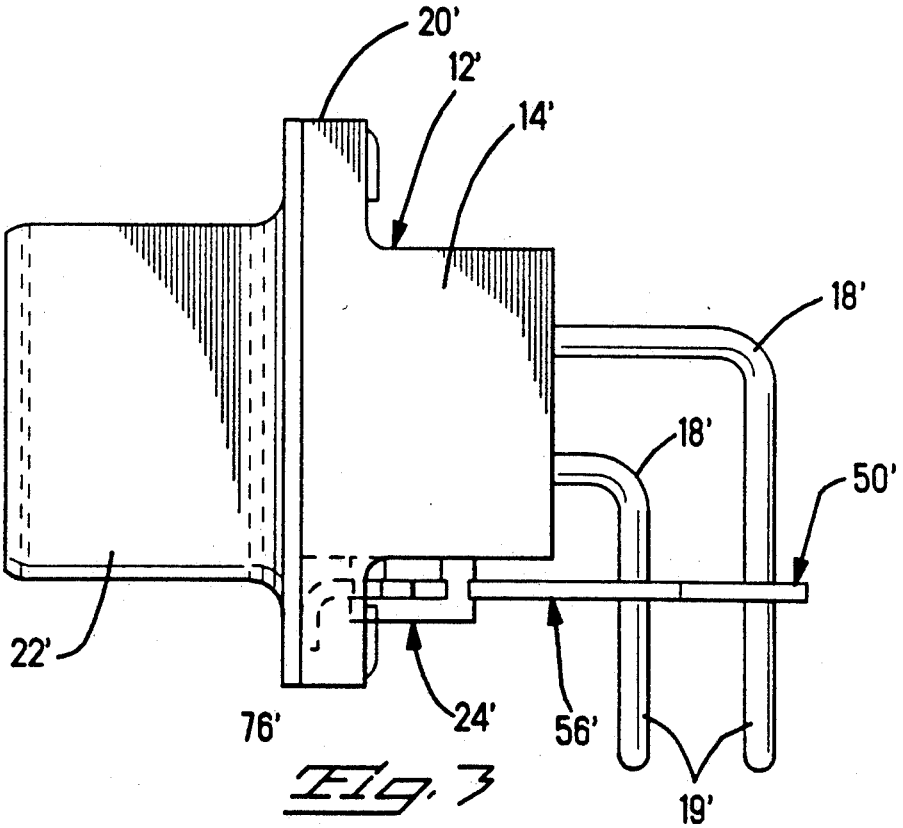
FIG. 3 is a side view similar to that of FIG. 2 with an alternative embodiment of the device shown applied to the connector.

In FIG. 3, an alternative embodiment 12' of the connector includes a housing 14', signal contacts 18' ended as at 19', a grounding shield 20' extending forwardly as at 22'. The essential difference between connector 12' and 12 is that 12' includes right angle posts 19 as part of signal contacts 18', which are intended to extend through the holes of a printed circuit board and be soldered thereto, with the device 24' nested beneath the connector 12', between the connector and a circuit board (not shown) to be joined to the signal and grounding shield as indicated in FIG. 3.

As can be appreciated from FIGS. 1–3, the invention contemplates an EOS device package that is conformable to reside within different connector profiles and configurations.

Referring now to the construction of the EOS device, reference is made to FIGS. 4–9. In FIG. 4, a profile including flat conductive metal blanks 40 and 62 are shown separated by edges as at 55 and 65, respectively. The blank 40 includes a carrier edge portion 42 having carrier holes 44, and the blank 62 includes an outside carrier 63 having carrier holes 64. Additionally, interiorly of the blanks are further holes 46 and 66 and the separation edge surfaces 55 and 65 of the blanks. Blank 40 further includes a series of first contacts 50 and 56 joining carrier 42 through terminal portions, such as the terminal portion 52 having aperture 54 connected to first contact 50; shorter first contacts 56 having terminal portions 58 having aperture 60. The first contacts 50 and 56 and the remaining corresponding first contacts of blank 40 are arranged in a pattern so that the apertures 54 and 60 are on centers complimentary to the contact centers of the connector, the post portions of signal contacts 18. The blanks 40 and 62 are preferably stamped and formed out of copper sheet material that is readily bendable. The blanks may be formed for prototype purposes by etching, but if this technique is utilized, the end surfaces 55 and 65 are preferably electropolished to provide a precise finish of constant surface dimension. The formed shape of an EOS device 24 can be seen in FIGS. 1, 2, 7, and 8 wherein the first contacts of 50 and 56 are bent, essentially at a right angle to the body of the device with the portions 76, oppositely bent to facilitate an interconnection of the device to a connector 12. In the embodiment of FIG. 3, the first contacts 50' and 56' are left unbent and straight, with the ends 76' being bent to be attached to the grounding shield 20' in the manner indicated.

Following a blanking as shown in FIG. 4, with the blanks 40 and 62 separated, a further step of manufacture is accomplished with the blanks being precisely positioned within a mold having an interior configuration to provide a molding of a cross-sectional configuration as shown in FIGS. 6, 7, and 9. There, as indicated, a housing 26 of plastic material 30 having an interior channel such as at 28, including a flat base 32, is molded around the first contacts 50 and 56 and the second contacts formed out of blank 62. As can be discerned from FIGS. 5 and 9, the plastic material of housing 26 is caused to flow through the apertures 46 and 66 to lock the contacts to the housing. Housing 26 is preferably molded onto blanks 40 and 62 of appreciable length, containing more contacts than would typically be used in a connector with subsequent cutting off of the appropriate length to define the numbers of contacts required.

In a preferred method of manufacture, the mold utilized to form a housing 26 has two parts of a cross-sectional configuration indicated in FIG. 6, the upper part 80 including a pair of cavities 82 that form the walls 30 of the housing and a lower part 86 having a cavity 88 that forms the bottom half of the housing. Centered in the upper part 80 of the mold is a piece of shim stock 84 that extends down into the cavity and against which the end surfaces 55 and 65 of the blanks are forced to define through the shim stock thickness a precise gap 71 therebetween. The mold utilized to mold housing 26 has a plan profile discernible from FIG. 5 with various projections extending down between the contacts 50 and 56 and down against the surfaces of stock 62, the material forming the housing is caused to flow through the apertures 46 and 66 as indicated. A thermoset material having thermally stable characteristics to maintain the gap spacing of the device in use and to withstand soldering temperatures when the device is soldered to the contacts and grounding shield is to be preferred. Certain other types of plastics capable of withstanding the higher temperatures of soldering, such as certain liquid crystal polymers or high temperature thermoplastics, may also be employed. As part of the invention method, the use of shim stock allows a precise dimensioning of the gap in that shim stock is available to extremely close thickness tolerances and in microfinishes allowing a very close placement of the end surfaces 55 and 65 to define the necessary gap control.

With a length of stock molded in the manner shown in FIG. 5, the invention contemplates a next step of method which is the filling of the cavity 28 in housing 26 in the manner indicated in FIG. 9 by a matrix material 72 forced therein under substantial pressure to flow within the gap 71. A number of the matrix materials have a rather doughy consistency and require substantial screw pressure in order to be made to flow within the narrow confines of gap 71, but experience has shown that this is readily achievable.

Following the operation indicated in FIG. 9 and the filling of gap 71 with matrix material 72, the blank and housing may be cut off to length to fit a given connector application and then left straight for an application in the manner shown in FIG. 3 or bent in the manner shown in FIG. 2 and as shown in FIGS. 1 and 8 to conform to the geometry of the connector.

FIG. 11 discloses an alternative embodiment 124 of the device having housing 126 with a channel 128. In this embodiment, the first and second contacts 150,168 extend into channel 128 such that they overlap one another and form a gap 171 between the surfaces of the overlying contacts. The housing 126 is made by overmolding the respective contacts in subsequential operation.

The invention contemplates a wide range of performance characteristics in terms of voltage transient suppression by selecting different gap dimensions and selecting different matrix materials for use therewith. In prototype applications utilizing matrix materials similar to those taught in the aforementioned patents and a gap dimension on the order of between 0.0020 and 0.0030 inches, a voltage suppression of a transient pulse on the order of 15,000 volts was clamped to a level of 18 volts within a period of 5 nanoseconds.

Having now described the invention in terms intended to enable a preferred practice thereof, claims are appended intended to define what is inventive.

We claim:

1. A device for use with an electrical connector for used in transmitting signals to and from electronic components of a type having a sensitivity to voltages above a given level to require electrical over-stress protection and a protection device therefor, the connector having at least one signal contact and at least a ground circuit with a plastic housing carrying said signal contact, said device having a plastic housing with means mounting the device on the connector, the device further including a first contact connected to the signal contact of the connector and a second contact connected to the ground circuit thereof, the device having first and second contacts each including a surface held by the housing of the device spaced apart by a given gap dimension with a matrix material formed of a mixture of conductive particles dispersed in an insulating medium extending between the surfaces of the first and second device contacts and with said given gap dimension and the characteristics of the matrix material selected to permit voltages above a given level to pass from a given signal contact through the contacts of said device to the ground circuit for circuit protection.

2. The device of claim 1 wherein the device housing includes a channel shape with a matrix material extending into said shape.

3. The device of claim 1 wherein said signal contact includes a post portion and the first contact of the device includes a portion engaging said post portion.

4. The device of claim 3 wherein the first contact includes a bendable portion extending between the device housing and the post portion adapted to be formed to conform to the connector housing shape.

5. The device of claim wherein the connector includes a plurality of signal contacts arranged in a given pattern and the device includes a like plurality of first contacts, one for each signal contact, positioned in said pattern with at least one ground contact common to the first contacts of the second contacts of the device.

6. The device of claim 1 wherein said gap is located between respective leading ends of said first and second contacts.

7. The device of claim 1 wherein a portion of said first contact overlies a corresponding portion of said second contact and said gap is located between said overlying portions.

8. An electrical over-stress protection device for use in protecting electrical components from voltage transients carried by signal leads to such components through a connector having signal contacts and a ground circuit of a given package geometry with the said contacts arranged in a pattern to fit within a printed circuit board and engage the mating contacts of a mating connector, the device being formed from flat metallic stock with first contacts individualized to include first ends arranged in a pattern compatible with the pattern of signal contacts and adapted to be connected thereto, the device including second contacts adapted to be connected to the ground circuit of the connector, the first and second contacts of the device including end surfaces, a housing carrying said contacts and positioning said end surfaces to define a selected gap therebetween, said housing including an interior volume with said surfaces positioned therein, a matrix material formed of a mixture of particles of selected conductive material dispersed in a selected insulating medium filling at least a portion of said volume to extend between and contact said end surfaces, the components matrix material and spacing characteristics between said particles all which, in conjunction with said selected gap, allow voltage transients to pass from a signal contact through the first contacts of the device to the second contacts and ground circuit to provide EOS protection.

9. The device of claim 8 wherein said contacts are formed of a bendable material facilitating a bending to conform to a given connector geometry.

10. The device of claim 8 wherein said channel is of a configuration to facilitate application of the matrix material under pressure to fill the said gap space between said surfaces.

11. The device of claim 8 wherein said first and second contacts are formed of a common flat stock material having carrier means to facilitate a precise placement of the surfaces within the said housing.

12. The device of claim 8 wherein said housing has walls with the contacts extending therefrom and a central channel with the contact surfaces extending in said channel and said material is flowed into said channel to fill said gap.

13. The device of claim 8 wherein said surfaces are formed at the ends of first and second contacts.

14. The device of claim 8 wherein said gap spacing is on the order of between 0.001 to 0.010 inches, preferably between 0.002 to 0.004 inches.

15. The device of claim 8 wherein said housing is formed of a rigid material having high temperature stability.

16. The device of claim 8 wherein the first contacts include a profile defining at least two rows of ends adapted to fit onto two rows of contacts.

17. The device of claim 8 wherein said gap is located between respective leading ends of said first and second contacts.

18. The device of claim 8 wherein a portion of said first contact overlies a corresponding portion of said second contact and said gap is located between said overlying portions.

* * * * *